US005148762A

United States Patent [19]

Liu et al.

[11] Patent Number: 5,148,762

[45] Date of Patent: Sep. 22, 1992

[54] SAFETY LINE HARNESS

[75] Inventors: Francis C. Liu, Camarillo, Calif.; Beth E. Harris, East Flat Rock, N.C.

[73] Assignee: The United States of America as represented by the Secretary of the Navy, Washington, D.C.

[21] Appl. No.: 612,299

[22] Filed: Nov. 13, 1990

[51] Int. Cl.[5] ..... B63B 21/04

[52] U.S. Cl. ..... 114/253; 114/247

[58] Field of Search ..... 114/210, 230, 253, 254, 114/242, 249, 250, 251, 247, 199

[56] References Cited

U.S. PATENT DOCUMENTS 518,880 4/1894 Evans ..... 114/223
1,378,102 5/1921 Froger ..... 114/253
2,072,387 3/1937 Sneed ..... 114/230
2,845,039 7/1958 Robbins ..... 114/210
3,113,547 12/1963 Stewart ..... 114/254

*Primary Examiner*—Jesus D. Sotelo
*Assistant Examiner*—Stephen P. Avila
*Attorney, Agent, or Firm*—Ron Billi; Melvin J. Sliwka

[57] ABSTRACT

A safety line harness for restraining and arresting the snap-back of a parted line to prevent casualty or injury, the safety line harness having at least one restraining line, with first and second ends, each restraining line attached to an attachment point and comunication with the harnessed line. When a harnessed line parts, the restraining lines of the present invention elongate to absorb the energy of the parted line and the parted line is restrained and arrested by the restraining lines.

17 Claims, 4 Drawing Sheets

SAFETY LINE HARNESS

BACKGROUND OF THE INVENTION

This invention relates to an apparatus for restraining the snap-back of a parted line thereby preventing casualty or injury. Parted or broken lines always present hazards on board ship and dockside as well as when testing, for example, synthetic or wire ropes. Previously, fences, covers or other shielding devices have been employed to contain a parted line, however, these devices require frequent replacement and are expensive. In addition, it is sometimes virtually impossible to install a cover or fence on board ship or while moored dockside because of the location of the line or the absence of suitable mounting points. Thus, there is a need in the art for providing an apparatus which restrains the snap-back of a parted line, is easily installed and is cost effective and durable. It is therefore an object of the present invention to provide a harness for restraining the snap-back of a parted line and for absorbing the energy of the snap-back to prevent injury and to retain the line. It is a further object of the invention to provide a harness that is cost effective, easy to install and durable.

SUMMARY OF THE INVENTION

Accordingly, the preferred embodiment of the safety line harness of the present invention includes a plurality of highly elastic restraining lines, the first end of each restraining line secured to a ship deck or other secure attachement point and the second end loosely communicating with the harnessed line, via a shackle. The restraining lines are arranged in groups of four, each group positioned to form an "X" configuration. A plurality of groups may be spaced along the length of the harnessed line. The harnessed line remains free to move axially and laterally without substantial impairment when the harnessed line is paid-out, reeled-in, stretched or moved to the side. When a harnessed line fails, the restraining lines elongate to absorb the kinetic energy of the now parted line and the broken ends of the harnessed line become entangled in the safety line harness thereby restraining the parted line from "flying away" and causing casualty or injury.

DETAILED DESCRIPTION OF THE PREFERRED EMBODIMENT

Figure 1:
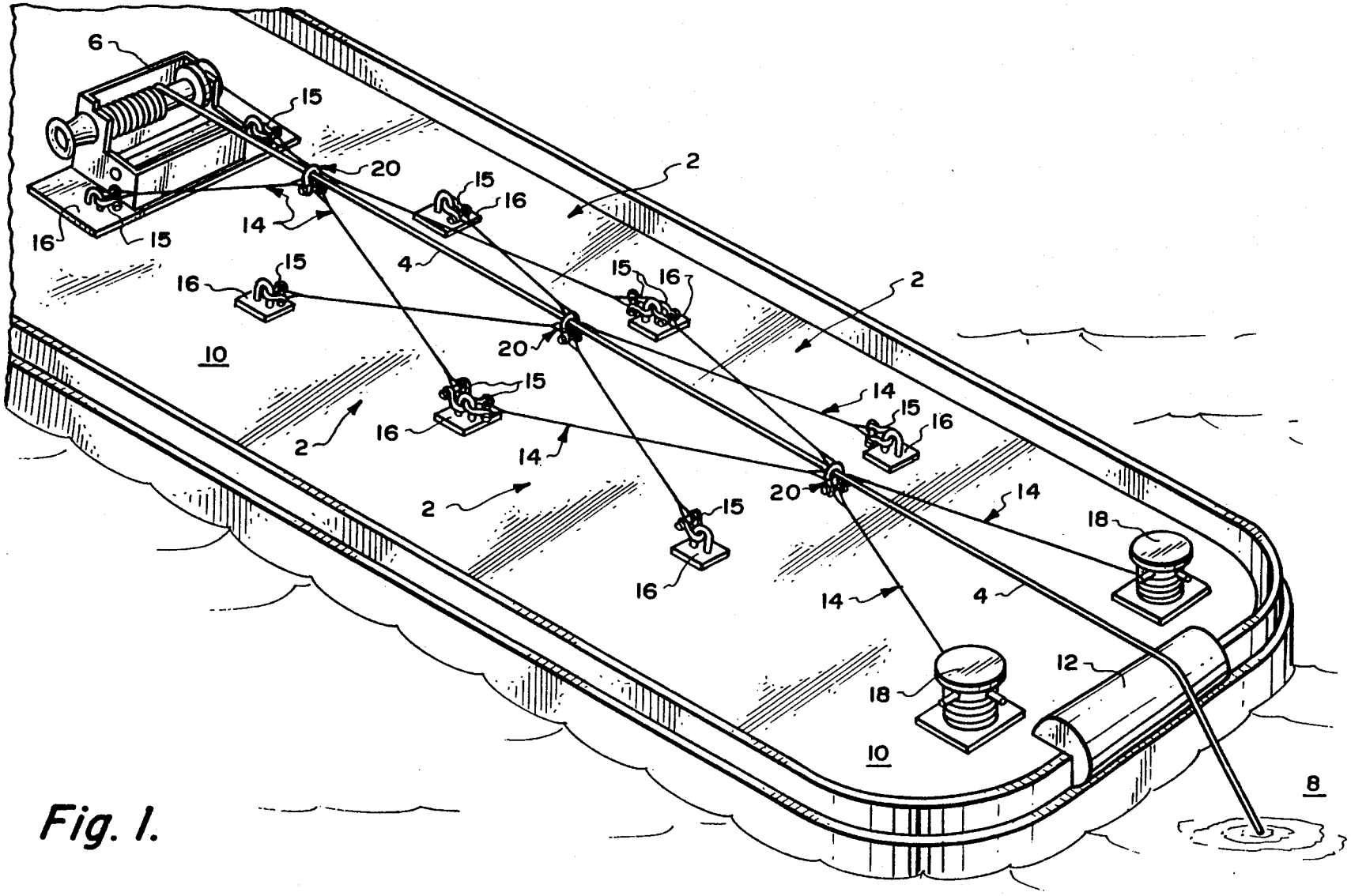
FIG. 1 is a perspective view of a preferred embodiment of the safety line harness of the present invention mounted on the deck of a ship.

As shown in FIG. 1, safety line harness 2 is installed to restrain and arrest harnessed line 4 in the event that harnessed line 4 parts (it should be noted that the nomenclature "harnessed line" denotes an unbroken line and a "parted line" denotes a broken harnessed line). As can be seen, harnessed line 4 is under tension, coiled on one end around winch 6 and attached on the other end, for example, to an anchor (not shown) below water surface 8. Winch 6 is securely attached to ship deck 10 and roller 12 acts as a guide when harnessed line 4 is paid-out or reeled-in.

Safety line harness 2 comprises a plurality of restraining lines 14, each restraining line 14 attached on a first end to a suitable mounting location such as pad eye 16 or bitt 18 and attached on a second end to passage shackle 20. When restraining line 14 is attached to pad eye 16, shackle 1k is placed between restraining line 14 and pad eye 16 (see FIG. 2). As can be seen in FIG. 3, passage shackle 20 is slidably fitted around harnessed line 4 with restraining line 14 attached to passage shackle 20. In this way, harnessed line 4 may be paid-out or reeled-in without substantial interference by passage shackle 20. Passage shackle 20 typically comprises clevis 22 and hitch pin 24 with cotter pin 26 installed in a bore (not shown) in one end of hitch pin 24. Many variations of shackles (connectors) are available and suitable and commonly known to those skilled in the art.

Passage shackles 20 are spaced apart along harnessed line 4, the spacing a function, for example, of cost and complexity versus degree of safety desired. The closer the spacing of passage shackles 20 the greater the tendency of safety line harness 2 to restrain and arrest a parted line 4 from flying away and causing injury or casualty. However, as the spacing gets closer and the number of passage shackles increases, the cost increases and the installation becomes more difficult to install and operate and more cumbersome. In the preferred embodiment, passage shackles 20 are spaced approximately 5 feet apart. In FIG. 1, a 5 foot spacing is shown for a 20 foot harnessed line measured from winch 6 to roller 12.

Figure 2:
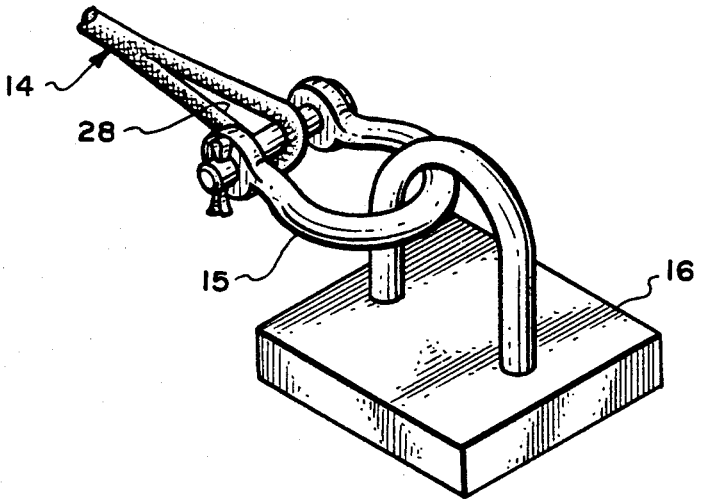
FIG. 2 is an illustration of a first end of a restraining line of the present invention attached to a pad eye via a shackle.
Figure 3:
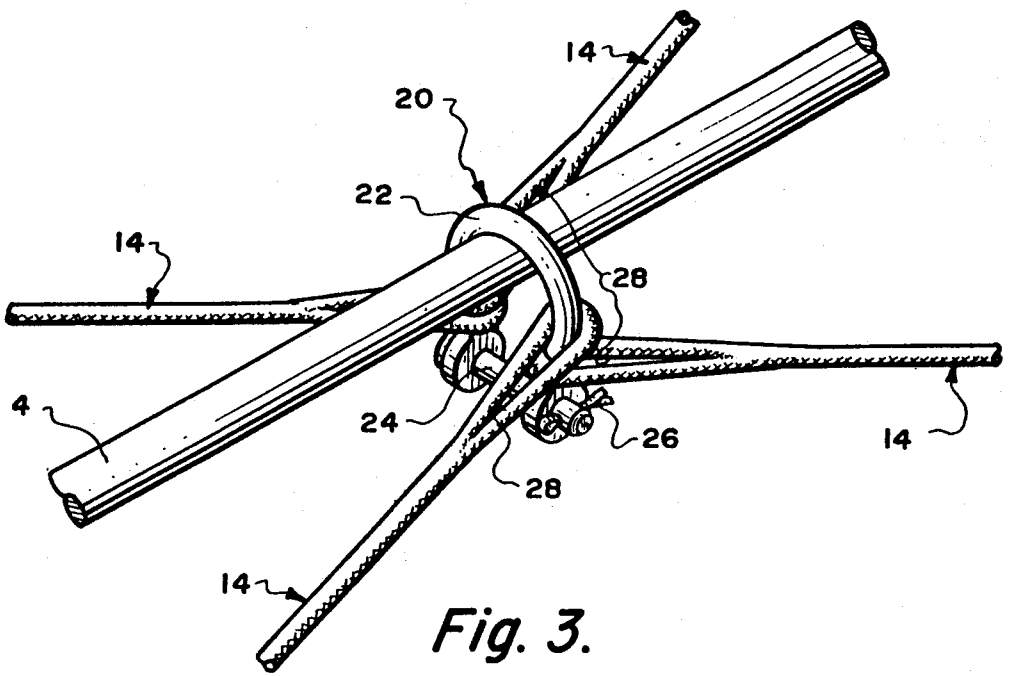
FIG. 3 is an illustration of a passage shackle of the present invention, slidably fitted around a potentially dangerous line and showing the second ends of four restraining lines attached to the passage shackle.

Both first and second ends of restraining lines 14 are formed in loops 28 (see FIGS. 2 or 3). Loops 28 are typically in the form of an eye splice, that is, the end of a restraining line 14 is looped and then braided back into itself to form a strong, durable connectable end. It can be appreciated that many end configurations are possible and known to those skilled in the art and, depending on the fastening fixtures available, other end configuration such as typing or wrapping may be utilized. An example of such an alternative configuration is shown in FIG. 1, where the two end restraining lines 14 are shown directly coiled, on one end, around bitts 18.

Restraining line 14 is typically formed from rope and is designed to absorb the energy of parted line 4 by stretching (elongating) thereby damping out the energy of flying away, parted line 4. It is desirable for restraining line 14 to include the properties of light weight, high strength and high elongation and shock absorption characteristics and, if required, exhibit these characteristics both in dry and wet conditions. Accordingly, in the preferred embodiment, harness line 14 is an 8-strand 100% nylon plaited rope. A suitable and preferred product is manufactured and commercially available from Columbian Rope Company, RT 1, Box 203, Guntown, Miss. 38849 and provides an approximate 21% elongation at a load of approximately 30% of the breaking strength. Other materials may also be used.

In the preferred embodiment, there are four restraining lines 14 per passage shackle 20. Accordingly, the breaking strength of restraining line 14 is in the range of approximately 0.1 to 0.2 times the breaking strength of harnessed line 4. When it is desired to increase the number of restraining lines 14 per passage shackle 20 beyond four, the breaking strength of restraining line 14 remains the same at 0.1 to 0.2 times the breaking strength of harnessed line 4. However, if the number of restraining lines 14 is reduced below four, for example, to two, then the desired breaking strength of restraining line 14 is increased (in this case doubled) to 0.2 to 0.4 times the breaking strength of harnessed line 4.

Figure 4:
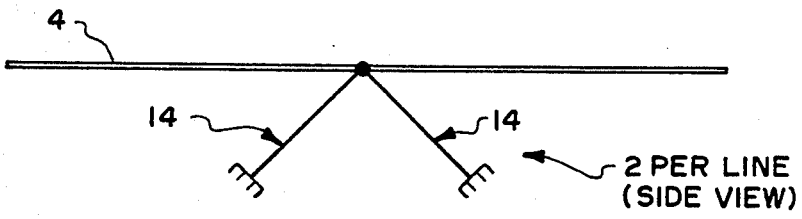
FIG. 4 is a plan view of an alternate restraining line configuration using two restraining lines.
Figure 5:
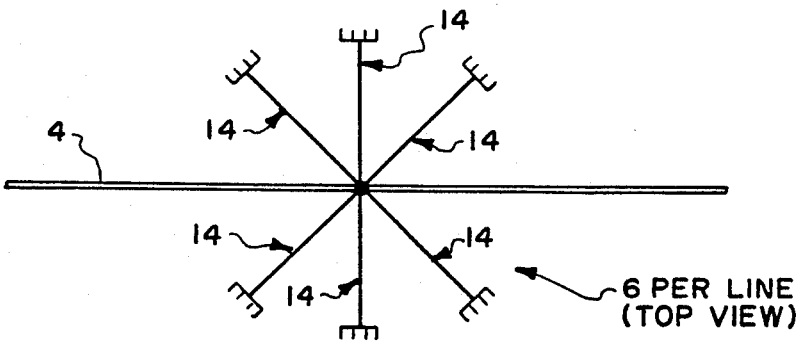
FIG. 5 is a top view of a second alternate restraining line configuration using six lines.
Figure 6:
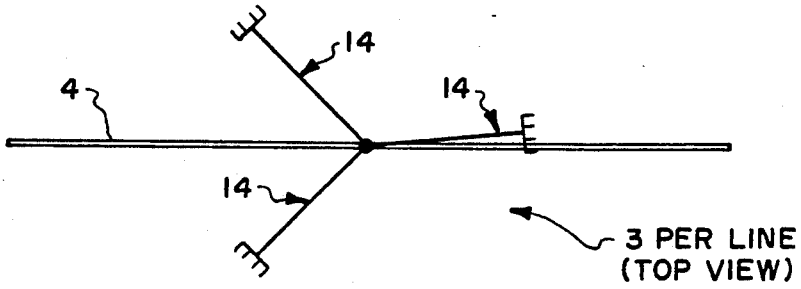
FIG. 6 is a top view of a third alternate restraining line configuration using three lines.

It should be noted that the preferred embodiment, as shown in FIG. 1, includes four restraining lines 14 per passage shackle 20. However, many other configurations are possible including those shown in FIGS. 4, 5 and 6. The number of restraining lines 14 chosen depends, for example, on a consideration of cost, complexity, number and strength of attachment points, traffic around safety harness 2 and the degree of protection desired. Restraining lines 14 may also be located above or on the sides of harnessed line 4 and each passage shackle 20 may contain different numbers, lengths and/or configurations of restraining lines 14.

It is desirable to make each restraining line 14 as long as practical (considering cost and space) to maximize the energy absorption characteristics of the system. In the preferred embodiment of FIG. 1, each restraining line 14 is approximately 15 feet long.

Figure 8:
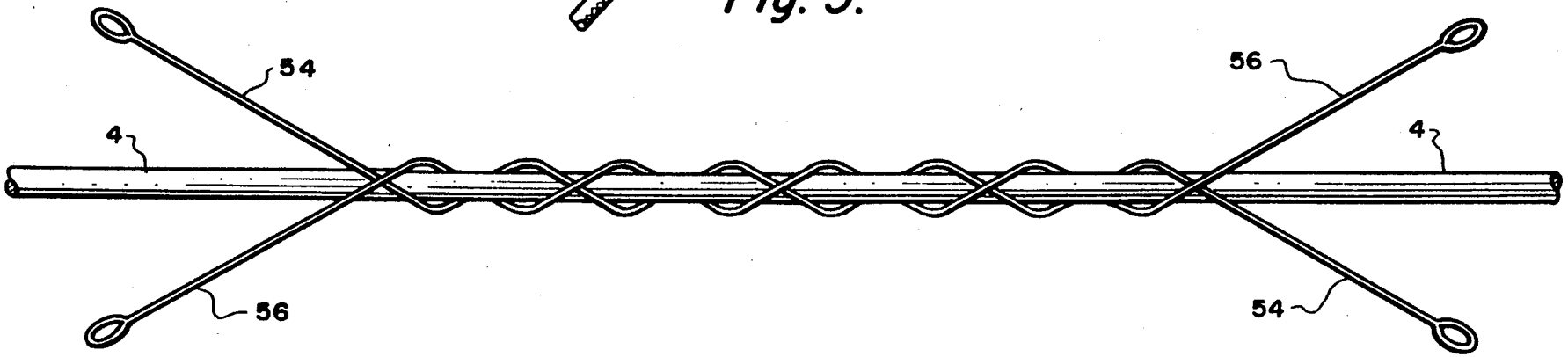
FIG. 8 is a detail of the cross coiling of a pair of restraining lines used when the safety line harness of the present invention is installed on a line testing machine.
Figure 7:
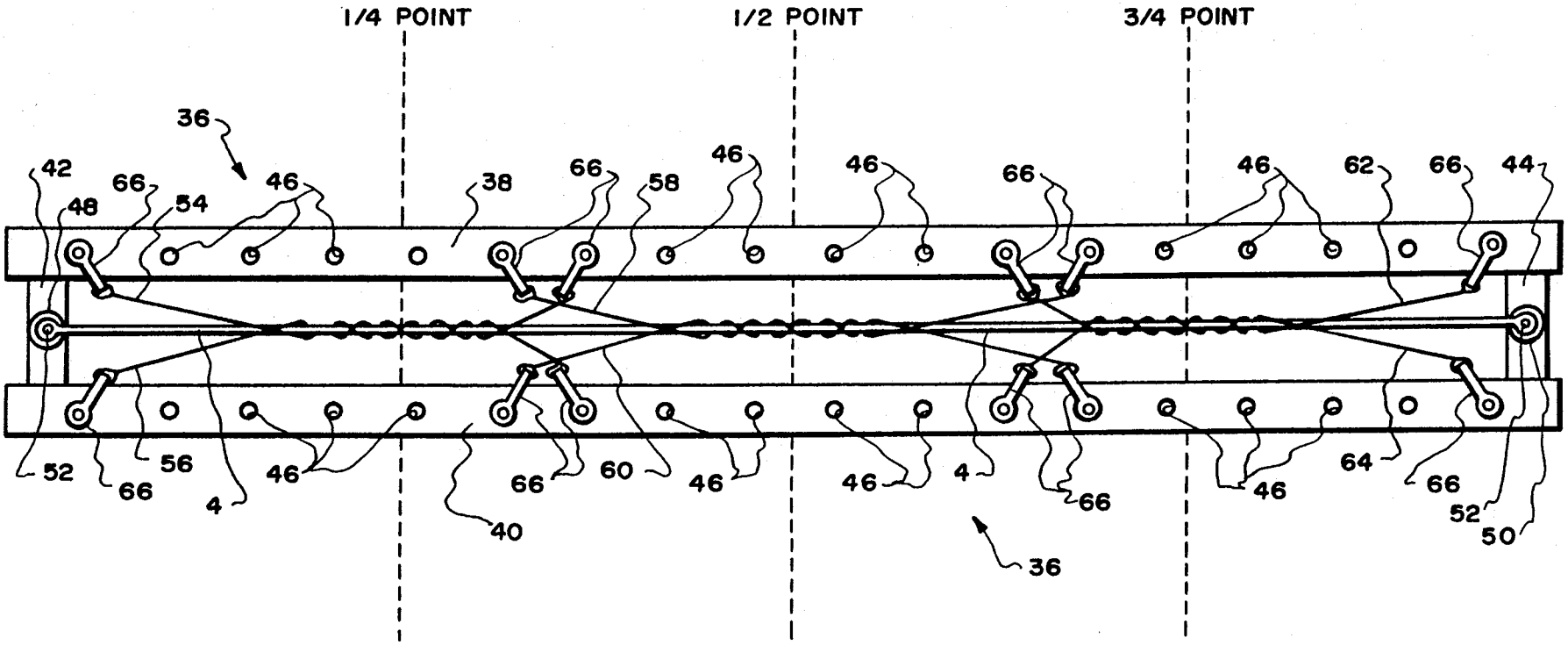
FIG. 7 is a top view of the safety line harness of the present invention installed on a line undergoing failure testing on a line testing machine.

FIG. 7 shows the present invention installed on harnessed line 4 undergoing testing in line testing machine 36. Line testing machine 36 includes parallel rails 38 and 40 and end pieces 42 and 44. A plurality of bores 46 are located in rails 38 and 40. Harnessed line 4 is shown being tested, that is, being stretched to failure. First end 48 and second end 50 of harnessed line 4 are pivotally connected to end piece 42 and 44 respectively by pins 52 fitted into bores (not shown). It should be noted that when safety line harness 2 is installed on a line testing machine 36, as in FIG. 7, the axial movement of harnessed line 4 is minimal when compared, for example, to an installation on board ship, where many feet of harnessed line 4 may be either paid-out or reeled-in. When the axial movement of harnessed line 4 is large, passage shackles 20, for example, are employed to attach restraining line 14 (see FIG. 1) to harnessed line 4 without substantially interrupting the axial motion of harnessed line 4. However, in the case of a line testing machine 36, as in FIG. 7, the axial motion of harnessed line 4 is minimal and restraining lines (designated 54, 56, 58, 60, 62 and 64 in FIG. 7) are loosely coiled around harnessed line 4. In this way, a parted line may be restrained and arrested without the use of passage shackles or similar devices. FIG. 7, shows three pairs of restraining lines: first pair includes restraining lines 54 and 56, second pair includes restraining lines 58 and 60 and third pair includes restraining lines 62 and 64. Each pair of restraining lines crosses: first pair crosses at approximately the ¼ point of harnessed line 4, second pair crosses at approximately the ½ point of harnessed line 4 and third pair crosses at approximately the ¾ point of harnessed line 4. As can be seen, the ends of each restraining line 14 are movably attached, by shackles 66, to opposite rails of line testing machine 36. Each restraining line 14 in FIG. 7 is loosely coiled two to four times around harnessed line 4 so that no restraining line interferes with the stretching (testing) of harnessed line 4. Preferably the restraining lines of each pair are coiled in opposite directions (see FIG. 8), that is, for example, restraining line 54 is coiled clockwise around harnessed line 4 and restraining line 56 is then coiled counterclockwise. When installed, all restraining lines are slack, that is, contain enough free play so that when harnessed line 4 is stretched, as in testing, no restraining line will cause a change in the test results of harnessed line 4. In FIG. 7, each restraining line contains approximately 6 inches of slack.

Obviously many modifications and variations of the present invention are possible in light of the above teachings. It is therefore to be understood that within the scope of the appended claims, the invention may be practiced otherwise than as specifically described.

What is claimed is:

1. A safety line harness for restraining and arresting the snap-back of a parted line comprising:

a) at least one restraining line, each restraining line capable of elongating to absorb the energy of the parted line, each said restraining line having a first end and a second end, the first end attached to an attachment point remote from said restraining line and the second end communicating with a harnessed line;

b) means for attaching said second end of said restraining line to the harnessed line, the attachment means communicating with said harnessed line and with said restraining line without said attachment means and said restraining line impairing the movement of said harnessed line when said harnessed line is moved laterally or moved axially.

2. The safety line harness defined in claim 1, wherein said attachment means communicates slidably with said harnessed line without impairing the movement of said harnessed line when said harnessed line is paid-out, reeled-in, moved laterally or moved axially.

3. The safety line harness defined in claim 1, wherein each said restraining line is attached to the same attachment means.

4. The safety line harness defined in claim 1, wherein each said restraining line is attached to a different attachment means.

5. The safety line harness defined in claim 1, wherein said restraining lines are arranged in groups, each group attached to a different said attachment means.

6. The safety line harness defined in claim 2, wherein said attachment means is a clevis.

7. The safety line harness defined in claim 3, wherein said attachment means is a clevis.

8. The safety line harness defined in claim 4, wherein said attachment means is a clevis.

9. The safety line harness defined in claim 5, wherein said attachment means is a clevis.

10. The safety line harness defined in claim 9, wherein there are three said groups of said restraining lines, each said group comprising four said restraining lines arranged in an "X" configuration with clevises located at the center of each "X".

11. The safety line harness defined in claim 10, wherein said clevises are spaced apart at 5 foot intervals along said harnessed line.

12. A safety line harness for restraining and arresting the snap-back of a parted line comprising:

at least one restraining line, each restraining line capable of elongating to absorb the energy of a parted line, each said restraining line having a first end and a second end, each end attached to an attachment point remote from said restraining line, said restraining line communicating with the harnessed line without impairing the movement of said harnessed line when said harnessed line is paid-out, reeled-in, moved laterally or moved axially.

13. The safety line harness defined in claim 12, wherein said restraining line communicates with said harnessed line by coiling said restraining line around said harnessed line.

14. The safety line harness defined in claim 13, wherein said restraining line is coiled around said harnessed line at least one turn.

15. The safety line harness defined in claim 13, wherein said restraining line is cross coiled around said harnessed line.

16. A safety line harness for restraining and arresting the snap-back of a parted line comprising:

a) at least one restraining line, each restraining line capable of elongating to absorb the energy of a parted line, each said restraining line having a first end and a second end, each end attached to said harnessed line, said restraining line communicating with an attachment point remote from said restraining line;

b) means for attaching each said end of said restraining line to said harnessed line without said attachment means and said restraining line impairing the movement of said harnessed line when said harnessed line is paid-out, reeled-in, moved laterally or moved axially.

17. The safety line harness defined in claim 16, wherein said attaching means is a clevis.

* * * * *